United States Patent [19]

Elias

[11] 4,311,199

[45] Jan. 19, 1982

[54] REUSEABLE PORTABLE FIREWALL

[76] Inventor: Josef Elias, 327 Cornwall St., San Francisco, Calif. 94118

[21] Appl. No.: 109,999

[22] Filed: Jan. 7, 1980

[51] Int. Cl.[3] ..... A62C 7/00

[52] U.S. Cl. ..... 169/48; 256/24; 256/65

[58] Field of Search ..... 256/24, 26, 27, 28, 256/29, 30, 12.5, 71, 68, 65; 169/48; 403/397, 398, 400; 160/135, 351

[56] References Cited

U.S. PATENT DOCUMENTS

| | | | |
|---|---|---|---|
| 59,427 | 11/1866 | Mather | 256/29 |
| 484,413 | 10/1892 | Espitallier | 256/28 UX |
| 589,062 | 8/1897 | Woodraff | 160/351 |
| 706,596 | 8/1902 | Poyner | 256/29 UX |
| 951,681 | 3/1910 | Dunlevy | 160/135 |
| 973,936 | 10/1910 | Graves | 160/135 |
| 3,489,444 | 1/1970 | Schmid | 403/400 |

FOREIGN PATENT DOCUMENTS

| | | | |
|---|---|---|---|
| 1230818 | 4/1960 | France | 256/24 |
| 1319579 | 6/1973 | United Kingdom | 403/397 |

*Primary Examiner*—Andrew V. Kundrat

*Attorney, Agent, or Firm*—Bielen and Peterson

[57] ABSTRACT

A portable firewall having in combination a plurality of modular panels fabricated from a fire resistant material; support rods constructed for placement at spaced intervals across a ground terrain and fasteners for quick attachment of the modular panels to the support rods forming a continuous vertical barrier to an advancing fire.

5 Claims, 6 Drawing Figures

REUSEABLE PORTABLE FIREWALL

BACKGROUND OF THE INVENTION

This invention relates to a device for controlling a forest or field fire. One of the greatest dangers to the maintenance and preservation of forests in North America is the forest fire which when unchecked can ravage huge acrages of field or forest land. The vast areas of open and forested land, unlike the limited and isolated timber stands of Europe, require special techniques in checking the spread of a fire once initiated. A fire that has advanced beyond initial stages cannot be fought from its windward side but rather must be checked and confined at its flanks and halted at its leeward side. The fire is then directed to an area which by the topology of the land enables the fire to be surrounded or causes it to burn out.

Various means are conventionally employed to check the local advance of the fire when an attack is made at the flanks or leeward side. Firebreaks comprising a swath of bulldozed land or land from which the combustibles are removed by other methods are one means. This requires either an ability to locate heavy equipment at the fire site, or the expenditure of extensive labor with portable equipment. Back burning in which a controllable fire is started and directed to meet the advancing fire also destroys combustibles. This suffers from the disadvantages that often much valuable land must be sacrificed to the advancing fire and that the backfire itself may rage out of control.

A means that is not highly labor extensive and that preserves as much land as possible is preferred.

SUMMARY OF THE INVENTION

The device of this invention for controlling a forest or field fire comprises a firewall unit that combines a plurality of light weight and portable modular panels fabricated from a fire resistant material with a plurality of support rods or stakes which during installation are driven vertically into the ground at spaced intervals for support of the modular panel in a continuous vertical barrier. Fasteners that can be quickly and easily applied are employed to secure the panels to the rods. Preferably the panels are fabricated from an aluminum sheet material for light weight and corrosion resistance. The sheet material is press stamped to form stiffening and structural support to the otherwise flexible sheet material. The stamping produces beveled relief segments in the panels which enable multiple panels to be stacked in nesting fashion during storage and during transport to the installation site. The light weight enables the transport of numerous panels for spot delivery by helicopter. At the delivery sites the rods can be erected and the panels installed in a short time.

DETAILED DESCRIPTION OF THE PREFERRED EMBODIMENTS

Figure 1:
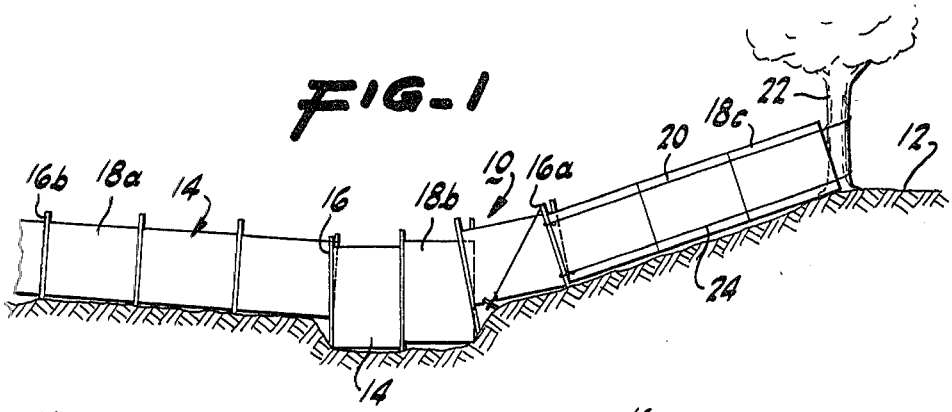
FIG. 1 is a schematic view of the firewall in a field installation.

Referring to the schematic view of FIG. 1, a firewall, designated generally by the reference numeral 10, is shown erected in an exemplar fashion on an irregular terrain 12. The firewall 10 comprises a series of modular rectangular panels 14, primarily interconnected at support rods 16 into a continuous fence-like wall. The panels are fabricated from a fire-resistant, lightweight material which in the preferred embodiment is aluminum. Each panel is fastened at each end to a support rod 16 or alternately, adjacent panels are fastened together and concurrently to a shared support rod. The panels are quickly erectable into a firewall as shown and are used and function in a manner similar to a firebreak. However, the vertical firewall has certain advantages over a firebreak. First, a minimum of flora is disturbed when employing the firewall to control a fire. Second, the fire as it approaches the firewall encounters an updraft at the face of the wall which interrupts the ground travel and inhibits cross-over or jumping of the fire across the barrier as is frequent when using a conventional firebreak. Any fire that does penetrate the firewall, for example, by creeping under the firewall, can easily be extinguished as it lacks the hot driving air. Furthermore, the fire can be more easily approached as the firewall provides a heat shield from intense radiant heat.

In FIG. 1, the illustrated firewall is arranged with a first portion 18 having the modular panels 14 oriented in a horizontal or lengthwise manner and supported by rods 16 at each end. A second portion **18*b* illustrates a special circumstance in which the rectangular panels 14 are oriented on end to effectively conform to the terrain, where in this case a ravine is encountered. A third portion 18*c* illustrates an alternate arrangement for supporting panels wherein a cable 20 is strung between a tree 22 and one of the rods 16*a* and the panels are fastened to the cable 20. A second bottom cable 24** is preferred to be included along the lower part of the firewall to tie down the panels during winds.

Figure 2:
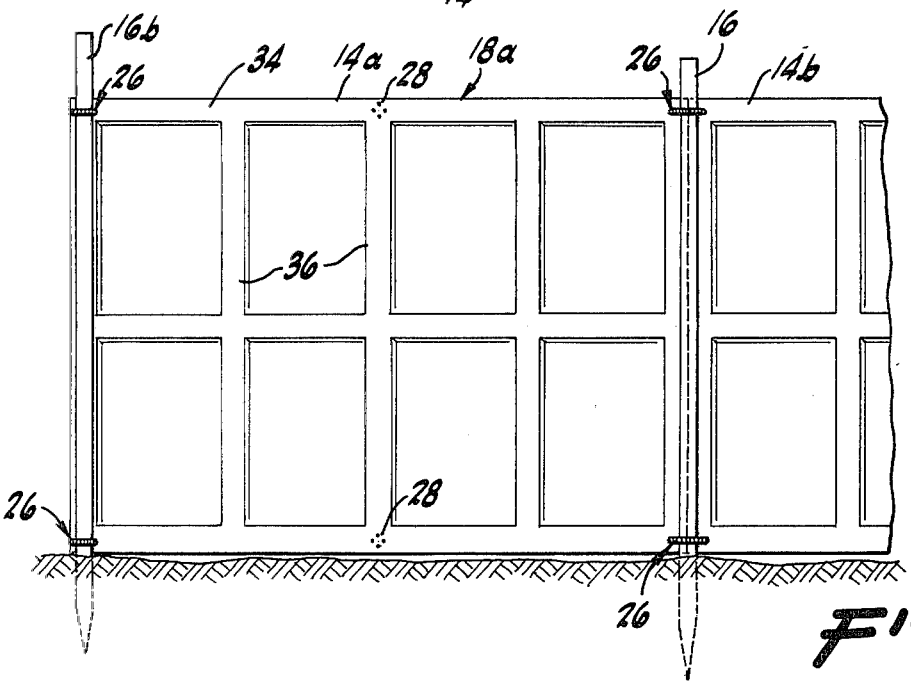
FIG. 2 is a front elevational view of the modular panels of the firewall of FIG. 1.

Referring now to FIG. 2, a segment of the first portion **18*a* of the firewall is shown enlarged to illustrate means for fastening the panels 14. As shown, the end panel 14*a* is fastened to the end rod 16*b* by straps 26 located at the top and bottom of the panel. The straps 26** are designed for rapid fastening and may simply comprise a piece of wire or preferably a flexible member to insure a secure attachment of the panel.

Figure 3:
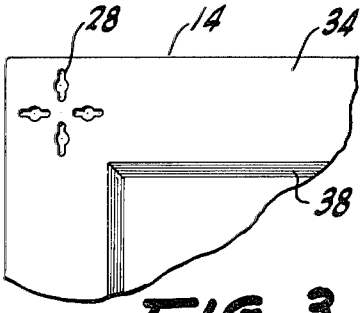
FIG. 3 is an enlarged segmental view of a corner of the modular panel.
Figure 4:
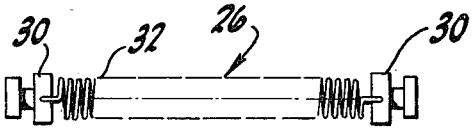
FIG. 4 is a top view of a panel fastener.
Figure 6:
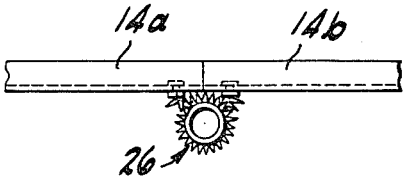
FIG. 6 is a top view of a panel fastener fastening two adjacent panels to a support rod.
Figure 5:
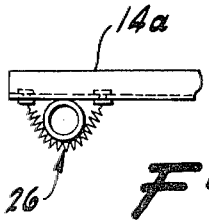
FIG. 5 is a top view of a panel fastener fastening a panel to a support rod.

In the preferred embodiment the corners of each panel include key slot holes 28 as shown in the portion of the panel of FIG. 3. The key slot holes 28 cooperate with circular slide buttons 30 attached at each end of a tension spring 32 in a manner similar to a conventional household chair lock for doors. The key slot holes 28 are arranged to permit the panels to be fastened when the panels are either horizontally oriented or oriented on end. The holes 28 are further arranged to allow fastening of the straps 26 around a rod on either a single panel as shown in the left portion of the panel **14*a* of FIG. 2, and in FIG. 5 or between two adjacent panels 14*a* and 14*b* as shown in FIG. 6**. In the latter arrangement, the fastener is wrapped around the rod to insure a firm fastening.

For installation on a cable, the same fasteners can be used or substitute fasteners such as S-hooks, wire lashing, etc., can be employed. Further, if expedient, the panels can be nailed directly to trees or existing fencing.

The panels are fabricated in a stamping process such that a raised border 34 and raised ribs 36 are formed. This provides a structural strengthening permitting a thin light-weight sheet material, preferably of aluminum to be used in large panel configurations. The panels shown are 8′×6′ with 4″ borders and ribs raised 2″ within a bevel 38 to enable panels to be stacked in nesting fashion for convenient storage and transportation. The rods are 8′×12′ in length and sharpened at an end for driving into the ground. To conserve weight the rods are hollow and may be stored and transported in bundles. The rods and panels are designed for transportation to the fire site by truck, car, or helicopter. Erection can be accomplished by driving stakes at eight foot intervals and subsequently lashing the panels to the rods. During high winds, an additional rod may be located at the mid-point on the panel and there secured by a strap.

While in the foregoing specification embodiments of the invention have been set forth in considerable detail for the purposes of making a complete disclosure of the invention, it will be apparent to those of ordinary skill in the art that numerous changes may be made in such details without departing from the spirit and principles of the invention.

What is claimed is:

1. A portable and quickly erectable firewall for retarding the advance of outdoor fires comprising a plurality of panel modules of a fire resistant material, said panel modules constructed of a thin, lightweight sheet material stamped with raised borders and ribs for structural strength enabling panel stacking in nesting fashion for convenient storage and transportation, and support and flexible interconnection means for supporting and allowing rapid interconnection of the panel modules into a continuous vertical wall-like barrier across and in conformance with terrain.

2. The firewall of claim 1 wherein the support means comprises support rods constructed for driving into the terrain, said support means including further means for fastening said panel modules to said support rods.

3. The firewall of claim 2 wherein said fastening means comprises straps and wherein said panel modules are fabricated with means to connect said straps to said panel modules.

4. The firewall of claim 3 wherein waid connecting means comprises selectively located holes in said panel modules.

5. The firewall of claim 4 wherein said panel modules are rectangular in configuration and said holes are located in each corner of said panel module.

* * * * *